US006273832B1

(12) United States Patent
Helmstetter et al.

(10) Patent No.: US 6,273,832 B1
(45) Date of Patent: Aug. 14, 2001

(54) COMBINATION GOLF CLUB WITH AN INSERT AND GOLF BALL

(75) Inventors: Richard C. Helmstetter, Rancho Santa Fe; Augustin W. Rollinson, San Diego; John G. Guard, Oceanside; James F. Dooley, Fallbrook; Victor S. Dennis, Rancho Santa Fe; Pijush Dewanjee, Oceanside, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/693,684

(22) Filed: Oct. 20, 2000

Related U.S. Application Data

(62) Division of application No. 09/389,798, filed on Sep. 3, 1999.

(51) Int. Cl.[7] ..... A63B 53/04; A63B 37/12

(52) U.S. Cl. ..... 473/324; 473/340; 473/342; 473/378; 473/351; 273/DIG. 8; 273/DIG. 22

(58) Field of Search ..... 473/324, 340, 473/342, 349, 347, 348, 290, 291, 131, 378, 329, 331, 332, 351, 251, 341; 273/DIG. 22, DIG. 8

(56) References Cited

U.S. PATENT DOCUMENTS 3,979,126 * 9/1976 Dusbiber .
4,141,559 * 2/1979 Melvin .
4,422,638 * 12/1983 Tucker .
4,792,140 * 12/1988 Yamaguchi .
5,000,459 * 3/1991 Isaac .
5,083,778 * 1/1992 Douglass .
5,106,094 * 4/1992 Desbiolles .
5,160,536 * 11/1992 Harris .
5,294,037 * 3/1994 Schmidt .
5,303,922 * 4/1994 Lo .
5,333,861 * 8/1994 Mills .
5,404,826 * 4/1995 Rudibaugh .
5,433,440 * 7/1995 Lin .
5,669,829 * 9/1997 Lin .
5,713,800 * 2/1998 Su .
5,830,077 * 11/1998 Yavitz .
6,001,930 * 12/1999 Rajagopalan .

FOREIGN PATENT DOCUMENTS

2584299 * 1/1987 (FR) ..... 273/173
2124910 * 2/1984 (GB) ..... 273/167 J

* cited by examiner

*Primary Examiner*—Sebastiano Passaniti
(74) *Attorney, Agent, or Firm*—Michael A. Catania

(57) ABSTRACT

A combination golf club with an insert and golf ball in which the cover of the golf ball and the insert are composed of substantially the same material. The preferred material is a thermoset polyurethane. An alternative material is an ionomer material. The golf club is preferably a putter.

11 Claims, 18 Drawing Sheets

FIG. 3
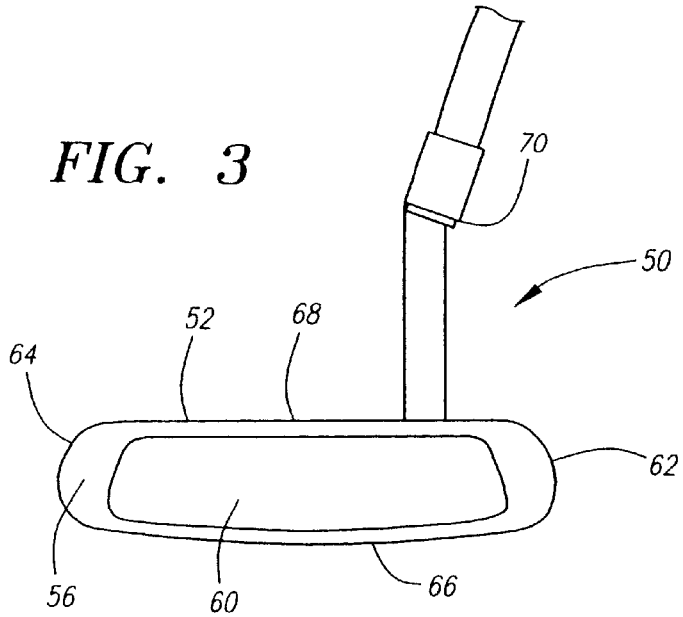
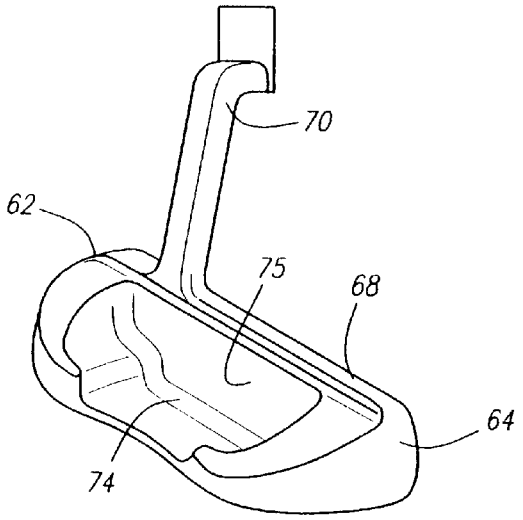
FIG. 3A
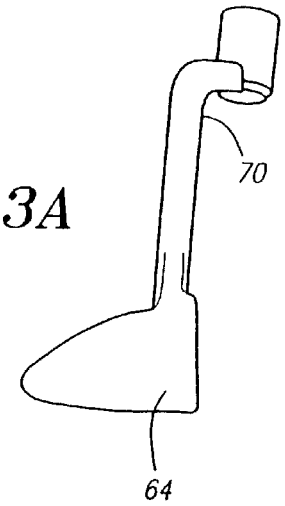
FIG. 3B
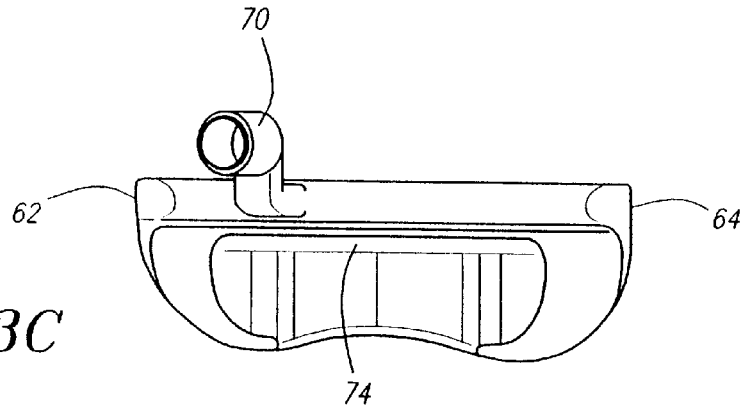
FIG. 3C

FIG. 5
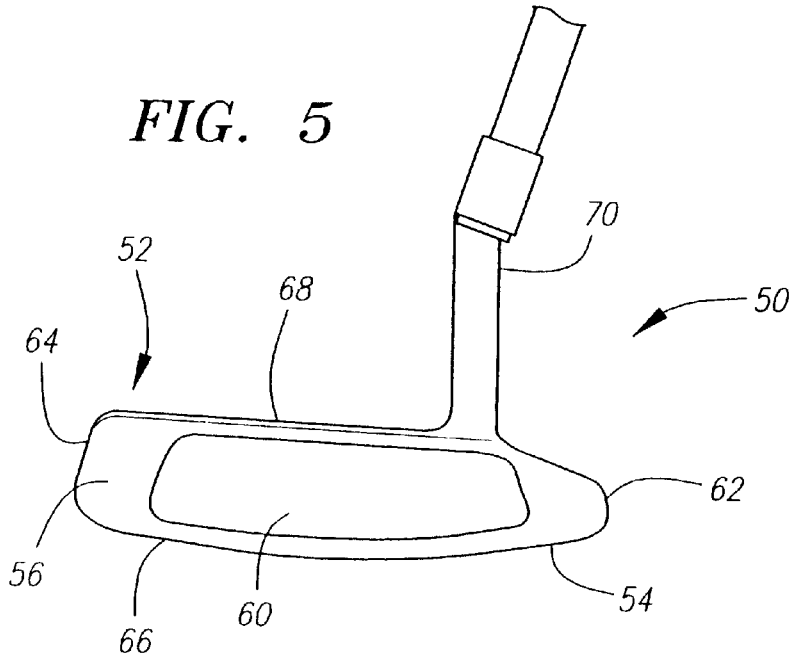
FIG. 5B
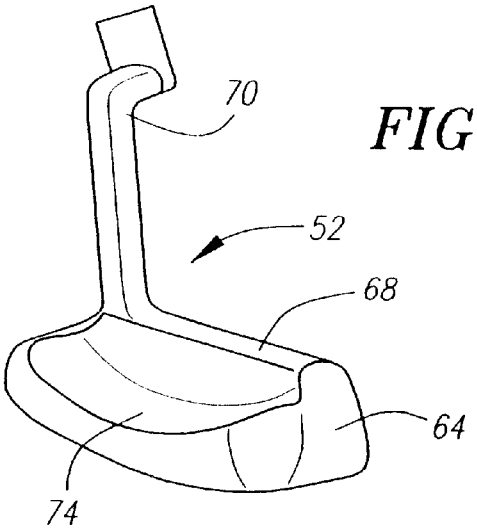
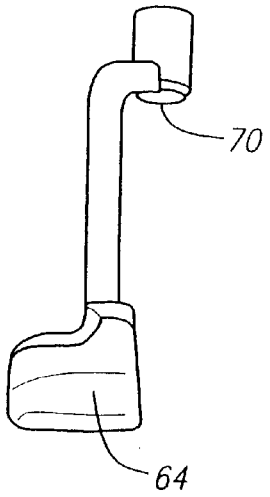
FIG. 5A
FIG. 5C
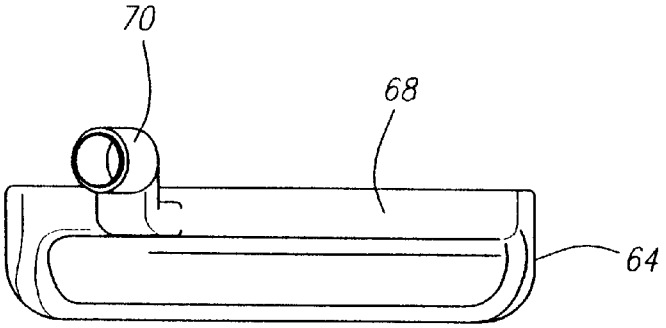

COMBINATION GOLF CLUB WITH AN INSERT AND GOLF BALL

CROSS REFERENCES TO RELATED APPLICATIONS

This application is a divisional application of co-pending U.S. patent application Ser. No. 09/389,798, filed on Sep. 3, 1999.

STATEMENT REGARDING FEDERALLY SPONSORED RESEARCH OR DEVELOPMENT

Not Applicable

BACKGROUND OF THE INVENTION

1. Field of the Invention

The present invention relates to a golf club with an insert and a golf ball in which the cover of the golf ball and the insert have substantially the same material.

2. Description of the Related Art

Throughout the history of golf, which dates back to as early as 1457, various techniques have been used to enhance the hitting characteristics of golf club heads. Golf club heads having inserts for the striking portion have been used at least as far back as 1880's when leather face irons were manufactured in Scotland. Golfer's in the 1890's were able to purchase putters with faces composed of gutta percha. More recently, inserts composed of various materials and shapes have been put forth by the creative geniuses of the golf industry to provide golfers with better feel and control of the golf ball.

One example is an ODYSSEY® putter having a STRONOMIC® insert that is disclosed in Magerman et al., U.S. Pat. No. 5,575,472 for a Golf Putter Head Having Face Insert And Method Of Forming The Same. The Magerman et al. Patent discloses a putter head with a recess into which is poured or inserted a resinous material which cures and is subsequently milled to produce the putter.

Another example is Pond, U.S. Pat. No. 5,524,331 for a Method For Manufacturing Golf Club Head With Integral Inserts that discloses a method for casting a graphite-epoxy composite insert within a recess of a face of a metal club head. The golf club head of the Pond Patent is directed at displacing the weight away from the center and increasing the moment of inertia.

Another example is Schmidt et al., U.S. Pat. No. 5,485,997, for a Golf Putter Head With Face Plate Insert Having Heightened Medial Portion, that discloses a putter head with a face plate composed of a non-metallic material such as an elastomer. The overall construction of the putter head of the Schmidt et al. Patent is directed at enlarging the sweet spot and improving the peripheral weighting.

Yet another example is found in Baker et al., U.S. Pat. No. 5,931,743 for a Putter Having Club Head With A Golf-Ball Engagement Insert And A Shaft Rearwardly Of The Insert which discloses a putter with a center shaft and an insert composed of a thermoplastic polyurethane. Another example is Jepson et al., U.S. Pat. No. 3,937,474 for a Golf Club With Polyurethane Insert, which discloses a wood having an insert on its striking face that is composed of a polyurethane formed from a tolylene diisocyanate polyether terminated prepolymer and a curing agent. The hardness of this insert varies from 40 to 75 shore D, and a Bashore Resiliometer of 17 or above. The polyurethane insert is claimed to impart additional energy to the golf ball during a golf hit.

Chen et al., U.S. Pat. No. 5,743,813 for a Golf Club Head discloses a wood composed of stainless steel with a three layer face having a first stainless steel layer, an elastic layer and a second stainless steel layer. The three-layer face does not absorb the hitting force when a golf ball is hit.

Fisher, U.S. Pat. No. 5,458,332, for a Golf Putter Head With A Cushioning Face, discloses a set of golf putters, each having an insert composed of polyurethane with a hardness in the range of 70 Shore A to about 80 Shore D. The rebound factor of each of the inserts is in the range of 12.5% to 50%, and the inserts are formulated to effect a reproducible direct linear relationship between the rebound factor and the distance of the putt.

Yet another example is McGeeney et al, European Patent Application Number 0891790 for a Multiple Density Golf Club Head And Method Of Manufacturing which discloses a putter with a central segment composed of a thermoplastic elastomer or a thermoset polymer. Possible thermoplastic elastomers include styrene co-polymers, co-polyesters, polyurethanes, polyamides, olefins and vulcanates. Possible thermoset polymers include epoxides, polyimides and polyester resins. The central segment has a minimum durometer hardness of Shore D 50. The central segment is bounded by metallic heel and to portions. However, the use of inserts is restrained in order to maintain the integrity of the game of golf.

In this regard, the Rules of Golf, established and interpreted by the United States Golf Association ("USGA") and The Royal and Ancient Golf Club of Saint Andrews, sets forth certain requirements for a golf club head. The requirements for a golf club head are found in Rule 4 and appendix II. A complete description of the Rules of Golf are available on the USGA web page at www.usga.org. Although the Rules of Golf do not expressly state specific parameters for an insert for a putter, the Rules of Golf have been interpreted to establish that an insert for a putter should have a Shore A hardness greater than 87±2%, have a constant thickness, have a thickness of at least 0.125 inches, and not act like a spring.

The prior art is absent a golf club head that has an insert composed of a material that is soft, but above the USGA requirements, and has a sufficient Bayshore rebound to provide a golf ball with the necessary distance to reach the hole. Further, the prior art has failed to provide an insert that may easily attach to the club head body.

BRIEF SUMMARY OF THE INVENTION

The present invention provides a combination golf club with an insert and golf ball in which the cover of the golf ball and the insert are composed of the same material. The preferred material is a thermoset polyurethane. An alternative material is an ionomer material.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 3 is a front view of another embodiment of the golf club head of the present invention with an insert in the recess of the club head body.

FIG. 3A is a side view of the club head of FIG. 3.

FIG. 3B is a rear view of the club head of FIG. 3.

FIG. 3C is a top view of the club head of FIG. 3.

FIG. 5 is a front view of another embodiment of the golf club head of the present invention with an insert in the recess of the club head body.

FIG. 5A is a side view of the club head of FIG. 5.

FIG. 5B is a rear view of the club head of FIG. 5.

FIG. 5C is a top view of the club head of FIG. 5.

DETAILED DESCRIPTION OF THE INVENTION

Figure 1:
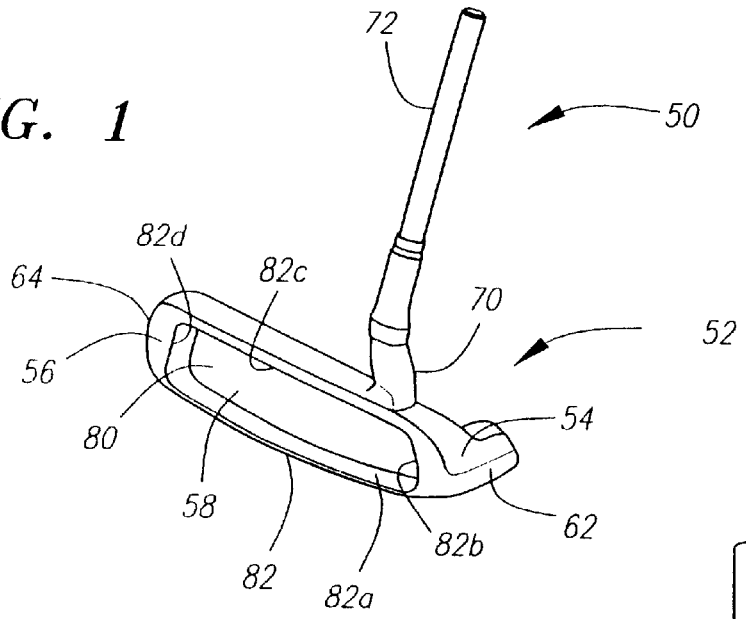
FIG. 1 is a perspective view of one embodiment of the golf club head of the present invention without an insert in the recess of the club head body.
Figure 1A:
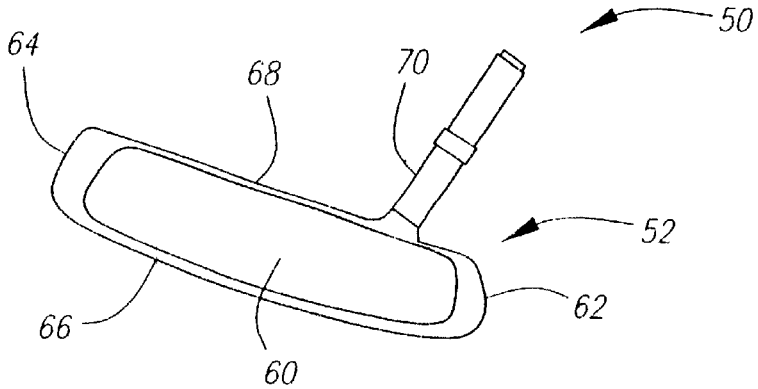
FIG. 1A is a front view of the club head of FIG. 1 with the insert placed therein.
Figure 1B:
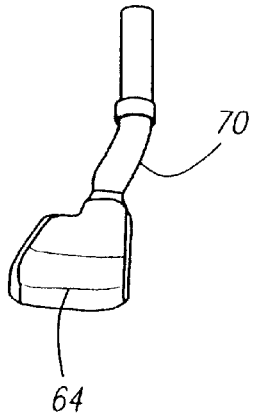
FIG. 1B is a side view of the club head of FIG. 1.
Figure 1C:
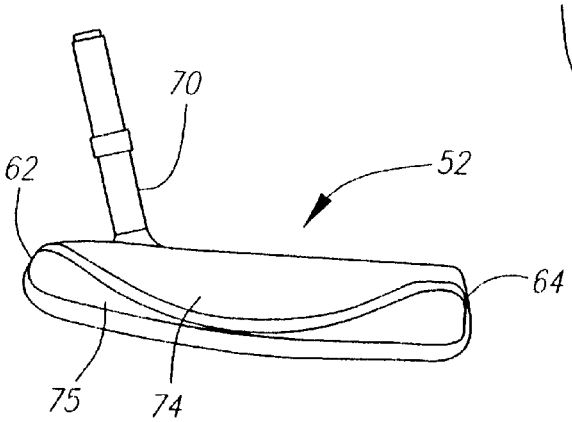
FIG. 1C is a rear view of the club head of FIG. 1.
Figure 1D:
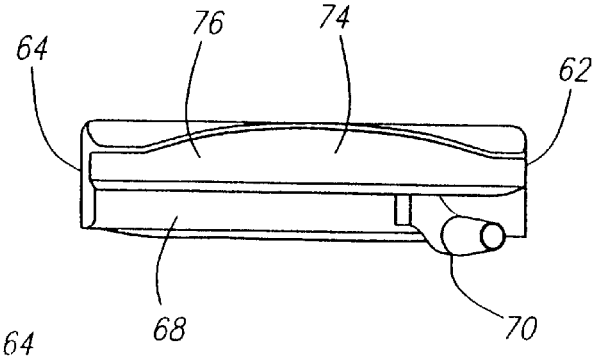
FIG. 1D is a top view of the club head of FIG. 1.

As shown in FIGS. 1 through 1D, a putter of the present invention is generally designated 50. The putter 50 includes a club head 52 having a body 54 with a front face 56 with a recess 58 therein. The club head 52 of the present invention also includes an insert 60 disposed within the recess 56. The insert 60 extends along most of the face 56 from a heel 62 of the club head 52 to a toe 64 of the club head 52, and from a sole 66 of the club head 52 to a crown 68 of the club head 52. The club head 52 also has a hosel 70 for connection to a shaft 72. Opposite of the front face 56 of the club head 52 is a rear 74 of the club head 52.

The body 54 of the club head 52 is preferably composed of a metallic material such as stainless steel. Other metallic materials include titanium, aluminum, tungsten, zinc, magnesium, and alloys of stainless steel and tungsten. However, those skilled in the pertinent art will recognize that the body 54 may be composed of other materials without departing from the scope and spirit of the present invention. Further, the non-insert portion of the face 56 may be smooth or textured to provide a consistent or non-consistent surface with the exterior surface of the insert. Additionally, the body 54 may be specifically weighted to provide a specific center of gravity and inertial properties for the putter 50.

FIGS. 2–6C illustrate various embodiments of putters 50 of the present invention. Each of the putters 50 of FIGS. 2–6C has a club head 52 with a body 54 and an insert 60 disposed within a recess 58 of the body 54. The putters 50 illustrated in FIGS. 1–6C are flanged blade, mallet and semi-mallet putters, however, those skilled in the art will recognize that other similar putter designs may be utilized without departing from the scope and spirit of the present invention. In a preferred embodiment, each of the club heads 52 weigh approximately 328 grams ±7 grams. Further, in a preferred embodiment, the recess 58 of each of the club heads 52 has a depth of approximately 0.205 inches ±0.010 inches.

Referring specifically to FIG. 1, the recess 58 of the body 54 is defined by a recess face wall 80 which is substantially parallel with the insert 60, and a recess edge wall 82 which is substantially perpendicular to the recess face wall 80. The recess face wall 80 defines the depth of the recess 58 that will determine the thickness of the polymer insert 60. The recess edge wall 82, as shown in FIG. 1, is composed of a bottom recess edge wall 82*a*, a heel recess edge wall 82*b*, a top recess edge wall 82*c* and a toe recess edge wall 82*d*. The recess edge wall 82 defines the shape of the recess 58, and the length of the recess edge wall 82 is determined by the depth of the recess 58. In a preferred embodiment, the insert 60 will engage the recess edge wall 82 as described below.

The putter 50 of FIGS. 1–1D is a flanged blade style putter. The rear 74 of the club head 52 has a rear wall 75 and a flanged portion 77. The insert 60 of this embodiment occupies approximately 67.90% of the face area of the club head 52. The insert 60 also occupies approximately 20.71% of the volume of the club head 52. Yet further, the insert 60 of this embodiment is approximately 3.95% of the weight of the club head 52.

Figure 2:
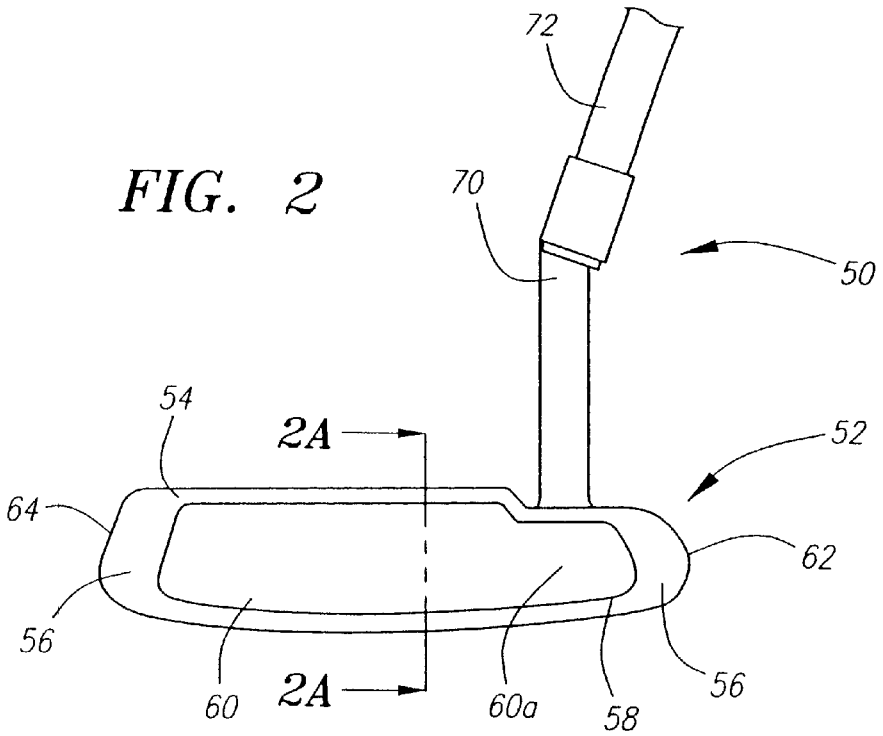
FIG. 2 is a front view of another embodiment of the golf club head of the present invention with an insert in the recess of the club head body.
Figure 2B:
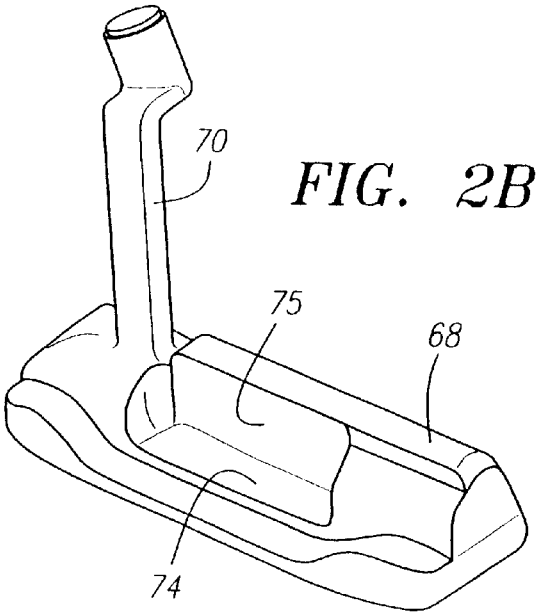
FIG. 2B is a rear view of the club head of FIG. 2.
Figure 2A:
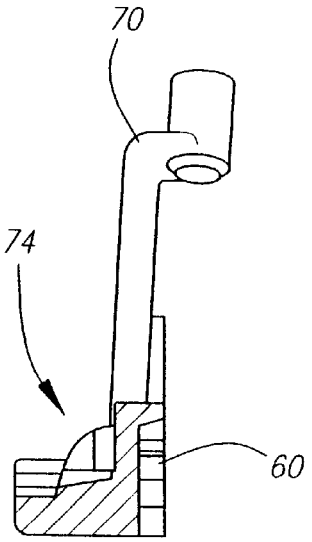
FIG. 2A is a partial cross-sectional side view of the club head of FIG. 2.
Figure 2C:
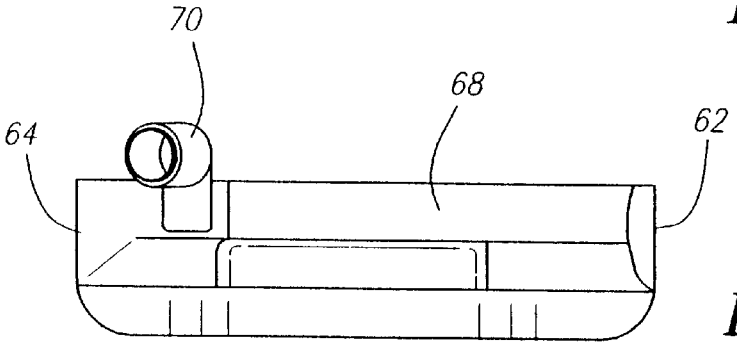
FIG. 2C is a top view of the club head of FIG. 2.

The putter 50 of FIGS. 2–2C is also a blade style putter, however, it has an offset hosel 70, and an insert 60 with a panhandle portion 60*a*. The insert 60 is one-piece, including the panhandle portion 60*a*. It is apparent from FIG. 2 that this putter 50 has a larger area of the non-insert portion of the face 56 than the embodiment shown in FIG. 1A. The insert 60 of this embodiment occupies approximately 69.22% of the face area of the club head 52. The insert 60 also occupies approximately 20.33% of the volume of the club head 52. Yet further, the insert 60 of this embodiment is approximately 3.86% of the weight of the club head 52.

The putter 50 of FIGS. 3–3C is a half-mallet style putter with an offset hosel 70. The insert 60 has a trapezoidal shape with parallel sides and a curved bottom portion. It is apparent from FIG. 3 that the toe end and heel end of the face 56 of this putter 50 has a large area of the non-insert portion. The insert 60 of this embodiment occupies approximately 68.27% of the face area of the club head 52. The insert 60 also occupies approximately 17.15% of the volume of the club head 52. Yet further, the insert 60 of this embodiment is approximately 3.08% of the weight of the club head 52.

Figure 4:
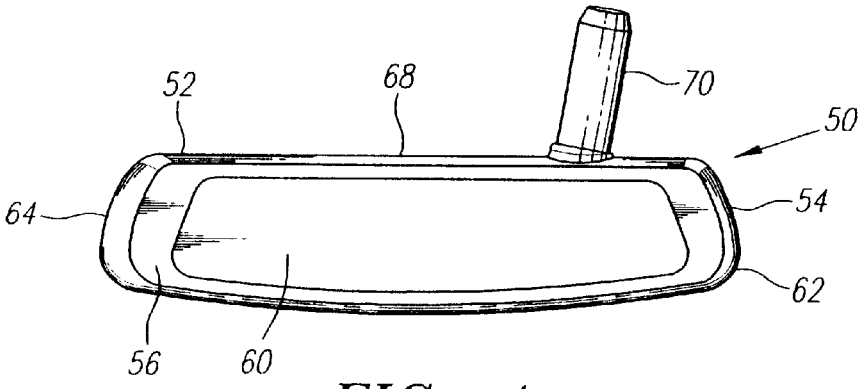
FIG. 4 is a front view of another embodiment of the golf club head of the present invention with an insert in the recess of the club head body.
Figure 4A:
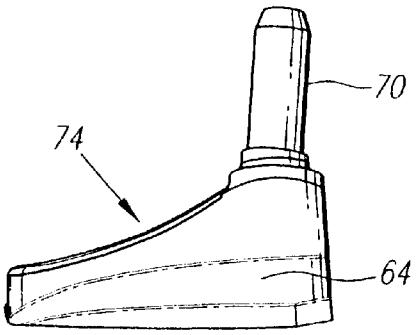
FIG. 4A is a side view of the club head of FIG. 4.
Figure 4B:
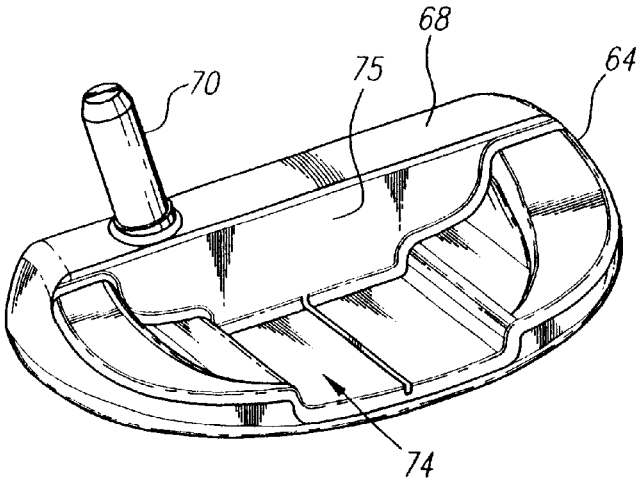
FIG. 4B is a rear view of the club head of FIG. 4.
Figure 4C:
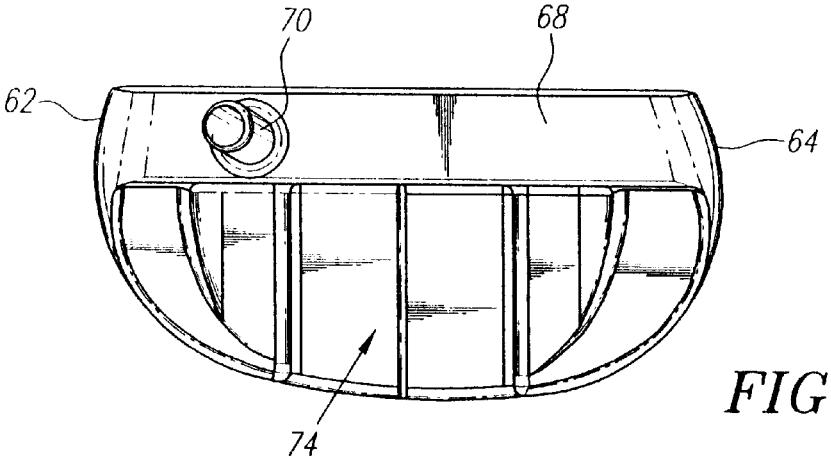
FIG. 4C is a top view of the club head of FIG. 4.

The putter of FIGS. 4–4C is a mallet style putter, however, it does not have an offset hosel 70. The insert 60 of this embodiment occupies the largest amount of the face area of the club head 52, approximately 70.38%. However, the insert 60 occupies the smallest volume of the club head 52, approximately 16.24%. Yet further, the insert 60 of this embodiment is the lightest, weighing approximately 2.46% of the club head 52.

Figure 6:
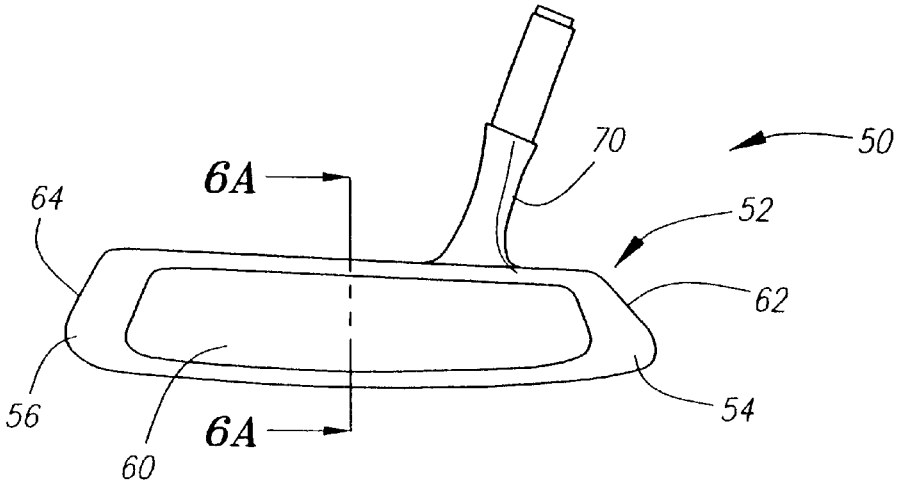
FIG. 6 is a front view of another embodiment of the golf club head of the present invention with an insert in the recess of the club head body.
Figure 6B:
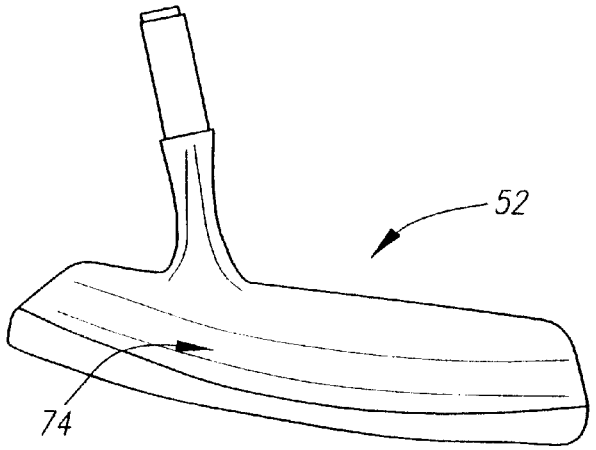
FIG. 6B is a rear view of the club head of FIG. 6.
Figure 6A:
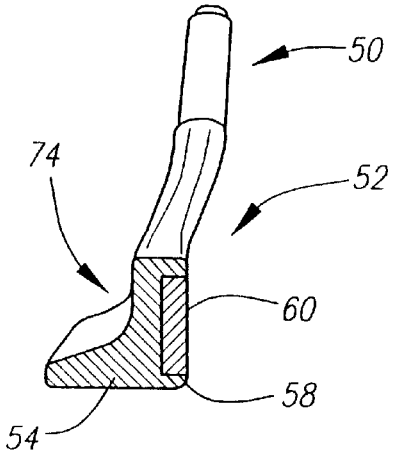
FIG. 6A is a partial cross-sectional side view of the club head of FIG. 6.
Figure 6C:
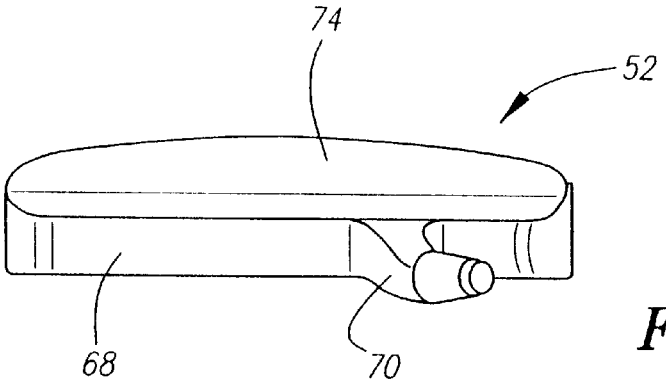
FIG. 6C is a top view of the club head of FIG. 6.

The putter 50 of FIGS. 5–5C is a flanged-blade style putter with an offset hosel 70. The insert 60 has a trapezoidal shape with parallel sides and a curved bottom portion. It is apparent from FIG. 5 that the toe end and heel end of the face 56 of this putter 50 has a non-insert portion larger than any of the other embodiments. The insert 60 of this embodiment only occupies approximately 59.82% of the face area of the club head 52. The insert 60 also occupies approximately 18.43% of the volume of the club head 52. Yet further, the insert 60 of this embodiment is approximately 3.42% of the weight of the club head 52. The putter of FIGS. 6–6C is a blade style putter. As shown in FIG. 6A, the polymer 60 only occupies a small portion of the volume of the club head 52 compared to the body 54 of the club head 52.

The inserts 60 of FIGS. 1–6C vary in shape and thickness depending on the design of the putter 50. A preferred shape of the insert 60 is a trapezoidal shape with curved corners. An alternative shape is a trapezoidal shape with a panhandle as illustrated in FIG. 2. The weight of the insert 60 may be adjusted, and may vary in a range of 1.0%–5% of the weight of the club head 52. Further, the volume of the insert 60 may vary between 10% and 25% of the volume of the club head 52. Additionally, the percentage of the face area occupied by the insert 60 may vary between 55% and 75% of the total area of the face 56.

Figure 7:
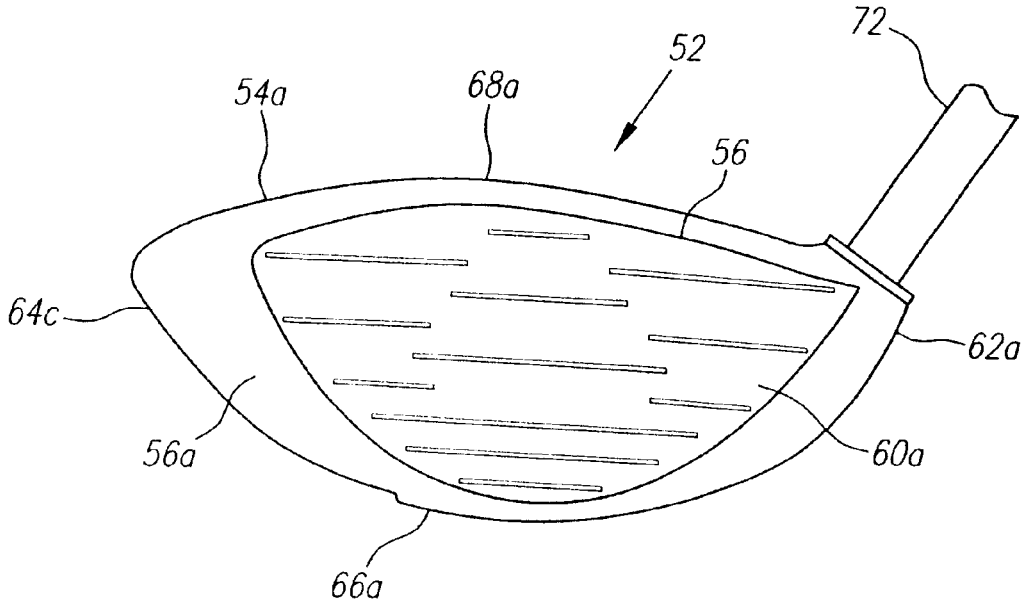
FIG. 7 is a front view of a wood club head with an insert of the present invention.
Figure 8:
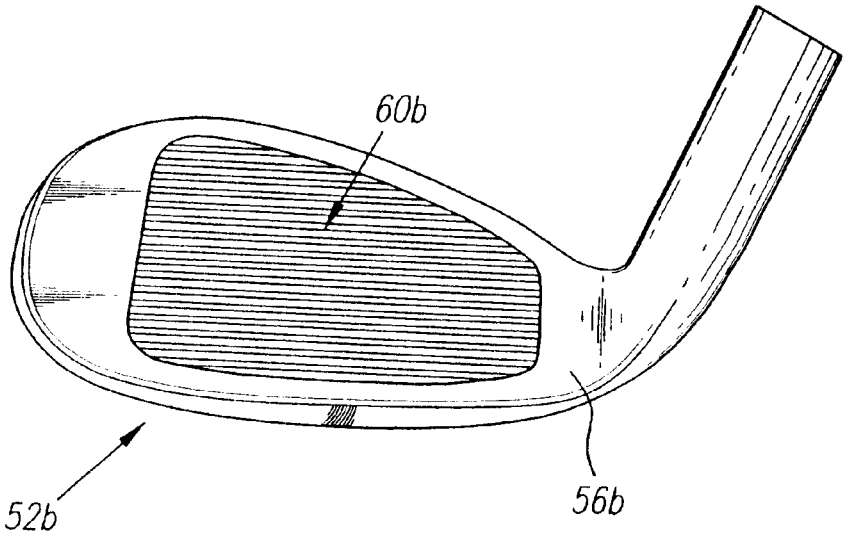
FIG. 8 is a front view of an iron club head with an insert of the present invention.

FIG. 7 illustrates yet another utilization of the insert 60*a* in a wood club head 52*a*. The insert 60*a* occupies most of the face 56*a*, from the heel 62*a* to the toe 64*a*, and from the sole 66*a* to the crown 68*a*. The body 54*a* of the club head 52*a* may be hollow, unlike the putters 50 of the previous embodiments. Further, the recess face wall, not shown, of the recess 58*a* will not abut the rear wall, not shown, unlike the putters 50 of the previous embodiments. The body 54*a* may be composed of titanium, or steel. FIG. 8 illustrates a further embodiment where the insert 60*b* is used on the face 56*b* of an iron club head 52*b*.

Figure 9:
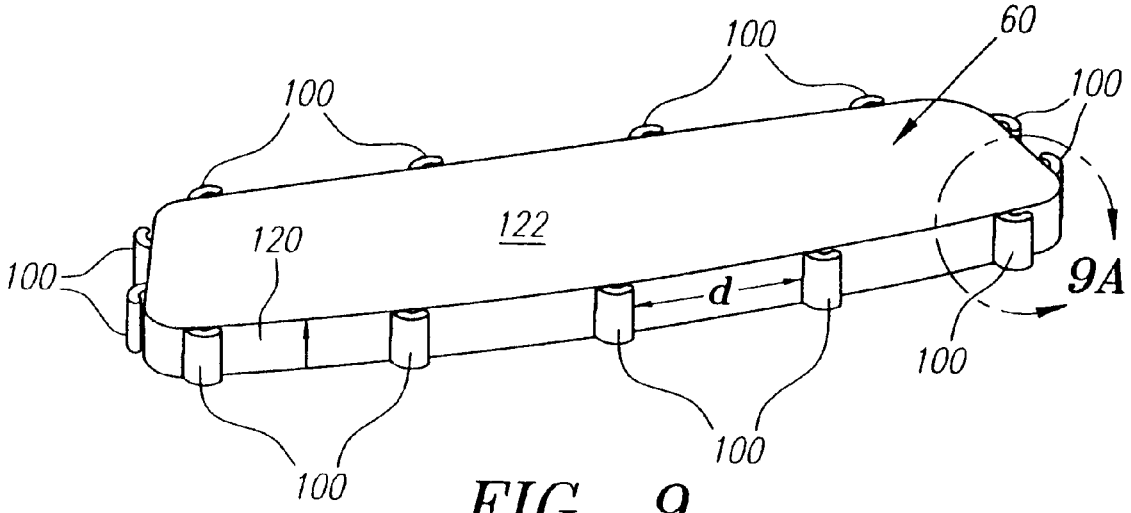
FIG. 9 is an isolated perspective view of one embodiment of the insert of the present invention.
Figure 9A:
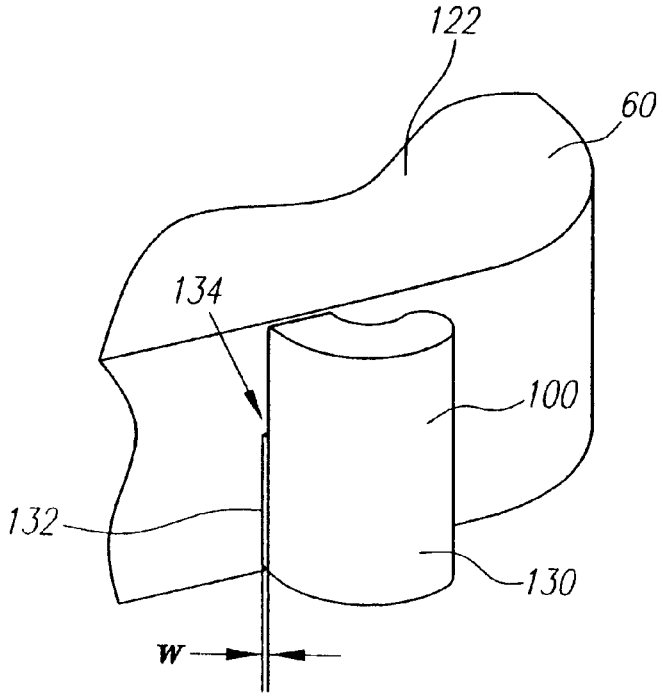
FIG. 9A is an enlarged view of circle A of FIG. 9.
Figure 10:
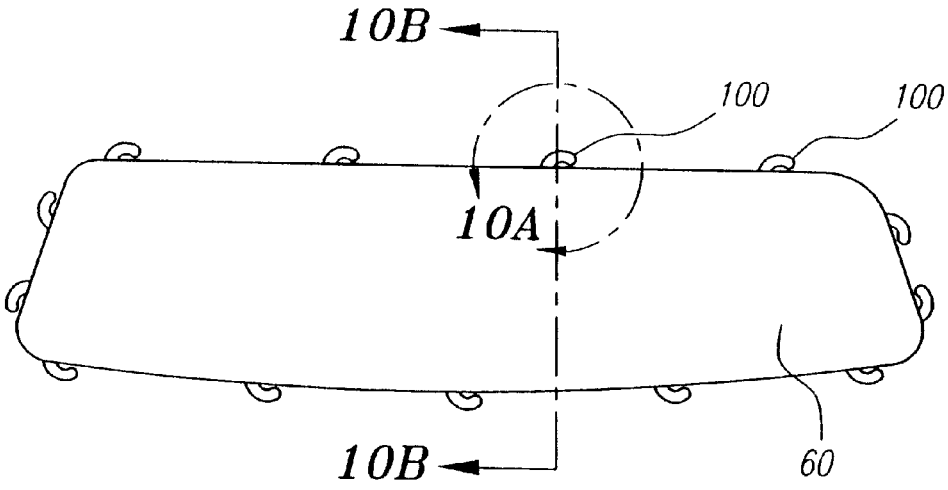
FIG. 10 is a front view of the insert of FIG. 9.
Figure 10A:
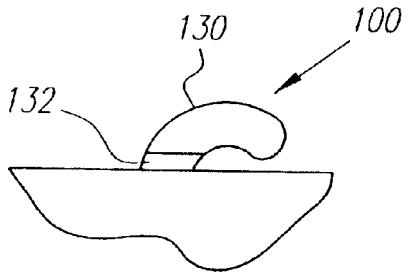
FIG. 10A is an enlarged view of circle A of FIG. 10.
Figure 10B:
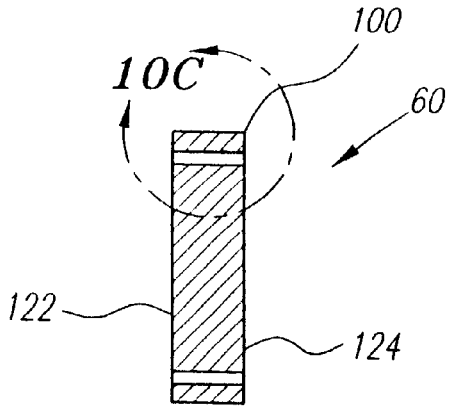
FIG. 10B is a cross-sectional view of the insert of FIG. 10 along lines B—B.
Figure 10C:
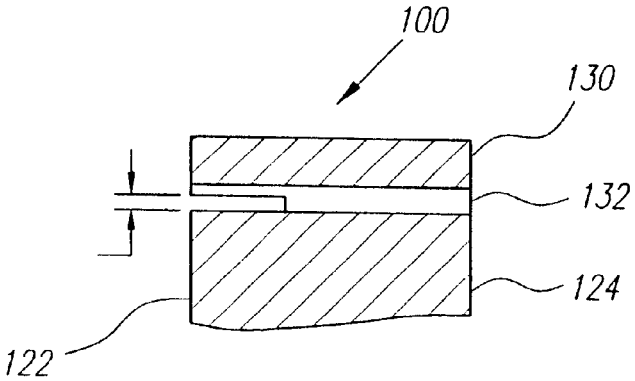
FIG. 10C is an enlarged view of circle C of FIG. 10B.

FIGS. 9–10C illustrate isolated views of one embodiment of the insert 60 of the present invention. The insert 60 has a plurality of tabs 100 spaced substantially equidistant apart. In a preferred embodiment, the distance "d" is 0.41 inches. However, those skilled in the pertinent art will recognize that the value of d may be adjusted for various embodiments. The plurality of tabs 100 lie on a perimeter 120 of the insert 60. The perimeter defines the thickness of the insert 60. A preferred thickness is 0.198 inches, however the thickness may preferably range from 0.125 to 0.50 inches. The insert 60 has an interior surface 124 and an exterior surface 122. The interior surface 124 faces the recess face wall 80 while the exterior surface 122 forms a portion of the face 56 of the club head 52.

In a preferred embodiment, each of the plurality of tabs 100 is composed of a curved portion 130 and a straight portion 132. The straight portion 132 projects from the perimeter 120 and becomes the curved portion 130. The curved portion 132 engages with the recess edge wall 82 of the recess 58 of the club head 52. An undercut 134 is formed between the curved portion 130 and the perimeter 120 on the exterior surface 122 side of the insert 60. The undercut 134 is cut from the straight portion 132 thereby creating a straight portion 132 that does not extend along the entire width of the perimeter 120. Further, the curved portion 130 does not extend along the entire width of the perimeter 120, terminating just prior to the exterior surface 122. However, the curved portion 130 does extend further than the straight portion 132. The height "h" of the undercut 134 is preferably 0.01 inches, however it may range from 0.005 inches to 0.025 inches. Each of the plurality of tabs 100 is compressible for engagement of the insert 60 into the recess 58 of the club head 52. As described below, an adhesive is filled between the tabs 100 and into the undercuts 134 when the insert 60 is mounted in the recess 58 of the club head 52.

Figure 11:
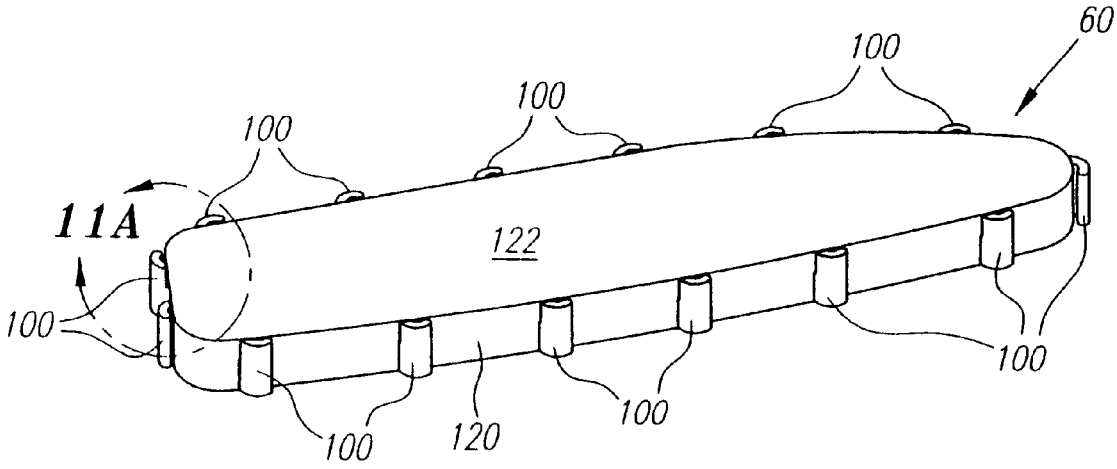
FIG. 11 is an isolated perspective view of an alternative embodiment of the insert of the present invention.
Figure 11A:
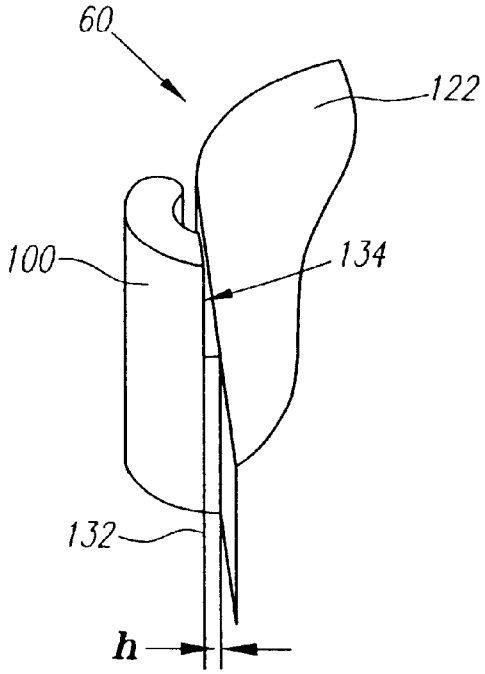
FIG. 11A is an enlarged view of circle A of FIG. 11.
Figure 12:
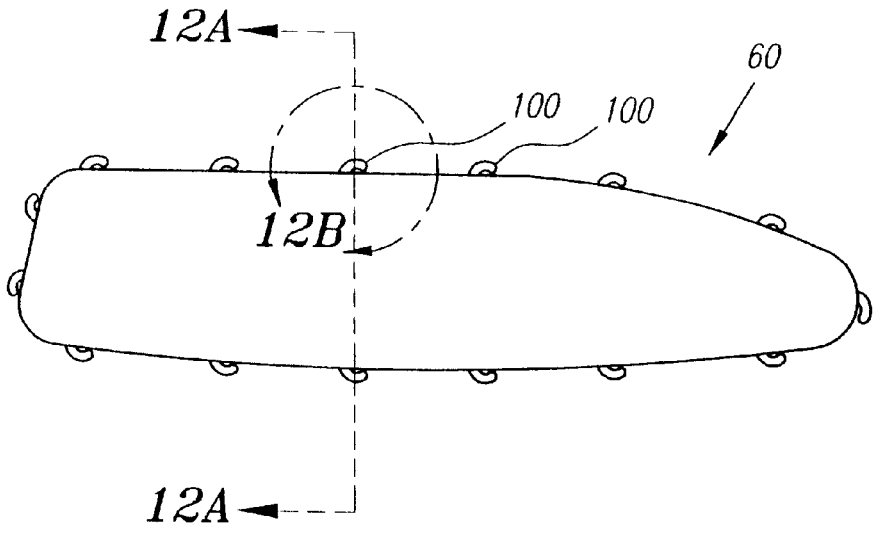
FIG. 12 is a front view of the insert of FIG. 11.
Figure 12B:
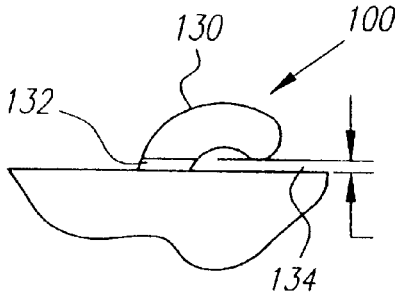
FIG. 12B is an enlarged view of circle B of FIG. 12.
Figure 12A:
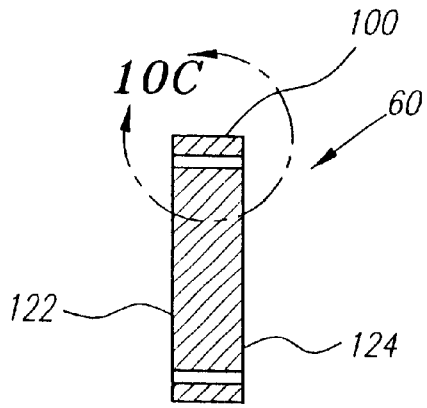
FIG. 12A is a cross-sectional view of the insert of FIG. 12 along lines A—A.
Figure 12C:
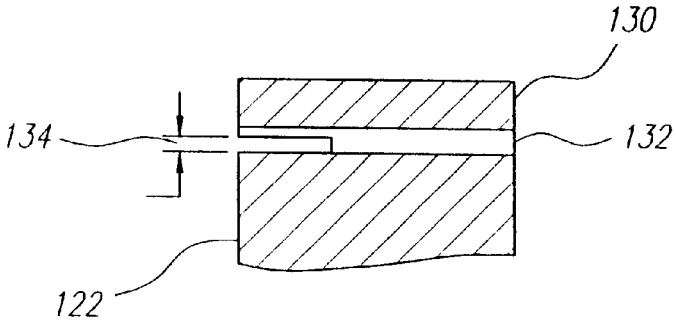
FIG. 12C is an enlarged view of circle C of FIG. 12A.

FIGS. 11–12C illustrate isolated views of a different embodiment of the insert of the present invention. The insert 60 of FIGS. 11–12C has different shape than the insert 60 of FIGS.

Figure 13:
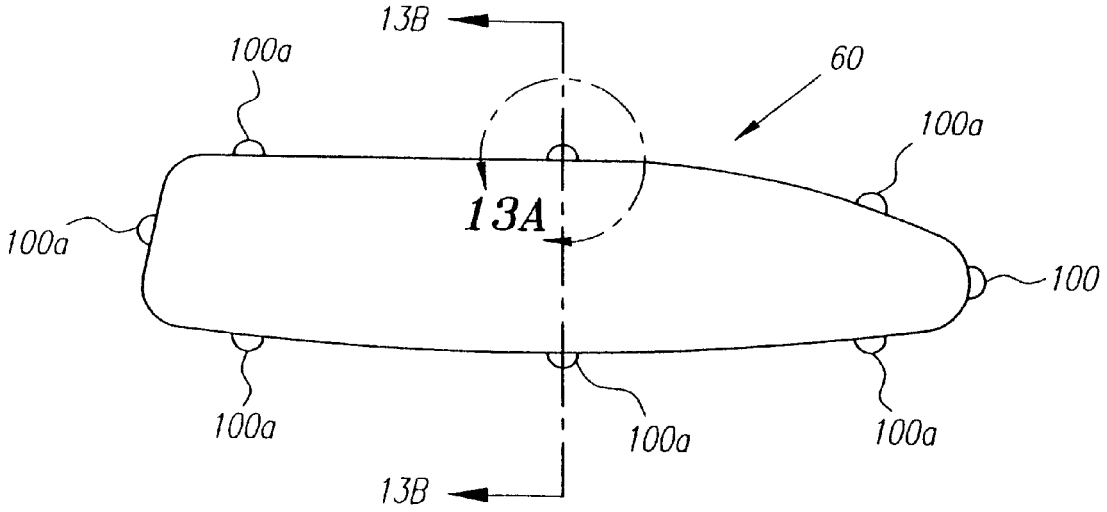
FIG. 13 is a front view of an alternative embodiment of the insert of the present invention.
Figure 13A:
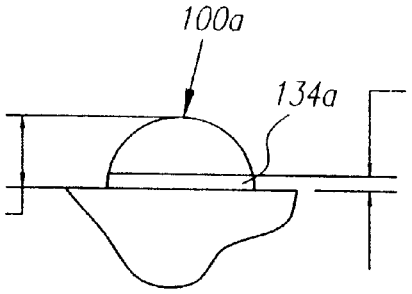
FIG. 13A is an enlarged view of circle A of FIG. 13.
Figure 13B:
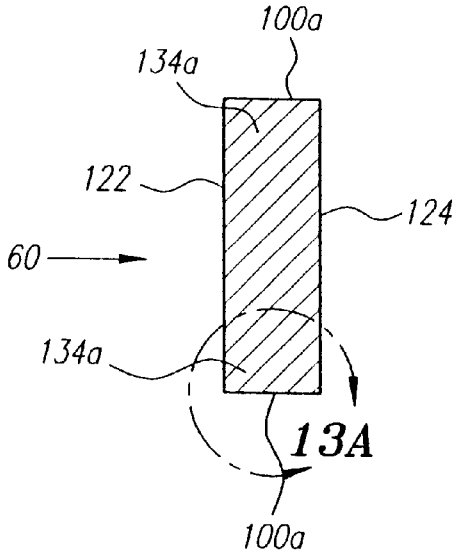
FIG. 13B is a cross-sectional view of the insert of FIG. 13 along lines B—B.
Figure 13C:
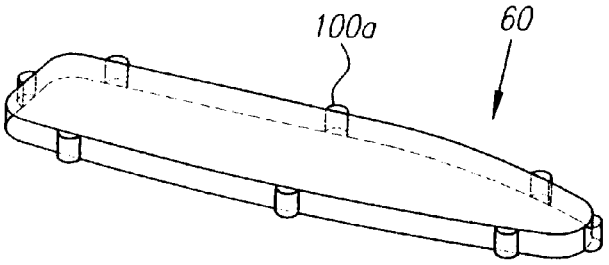
FIG. 13C is a perspective view of the insert of FIG. 13.

FIGS. 13–13C illustrate yet another embodiment of the insert 60 of the present invention. In this embodiment, each of the plurality of tabs 100*a* has a hemispherical shape with an undercut 134*a* on the exterior surface 122 side of the insert 60.

Figure 14:
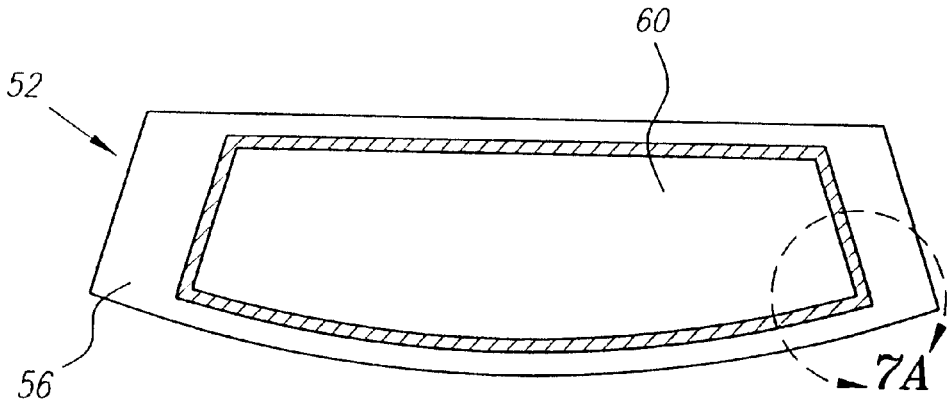
FIG. 14 is an isolated front view of an insert disposed within a recess of the face of a golf club head of the present invention.
Figure 14A:
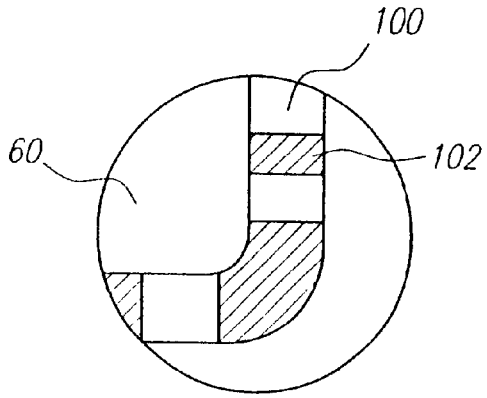
FIG. 14A is an enlarged view of the circle A of FIG. 14.
Figure 14B:
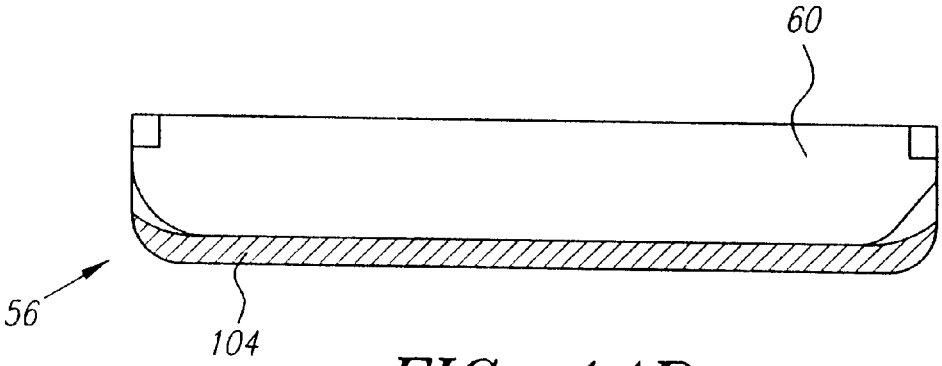
FIG. 14B is an isolated view of the insert within the recess of the club head, and bonded to the recess wall by an epoxy.
Figure 15:
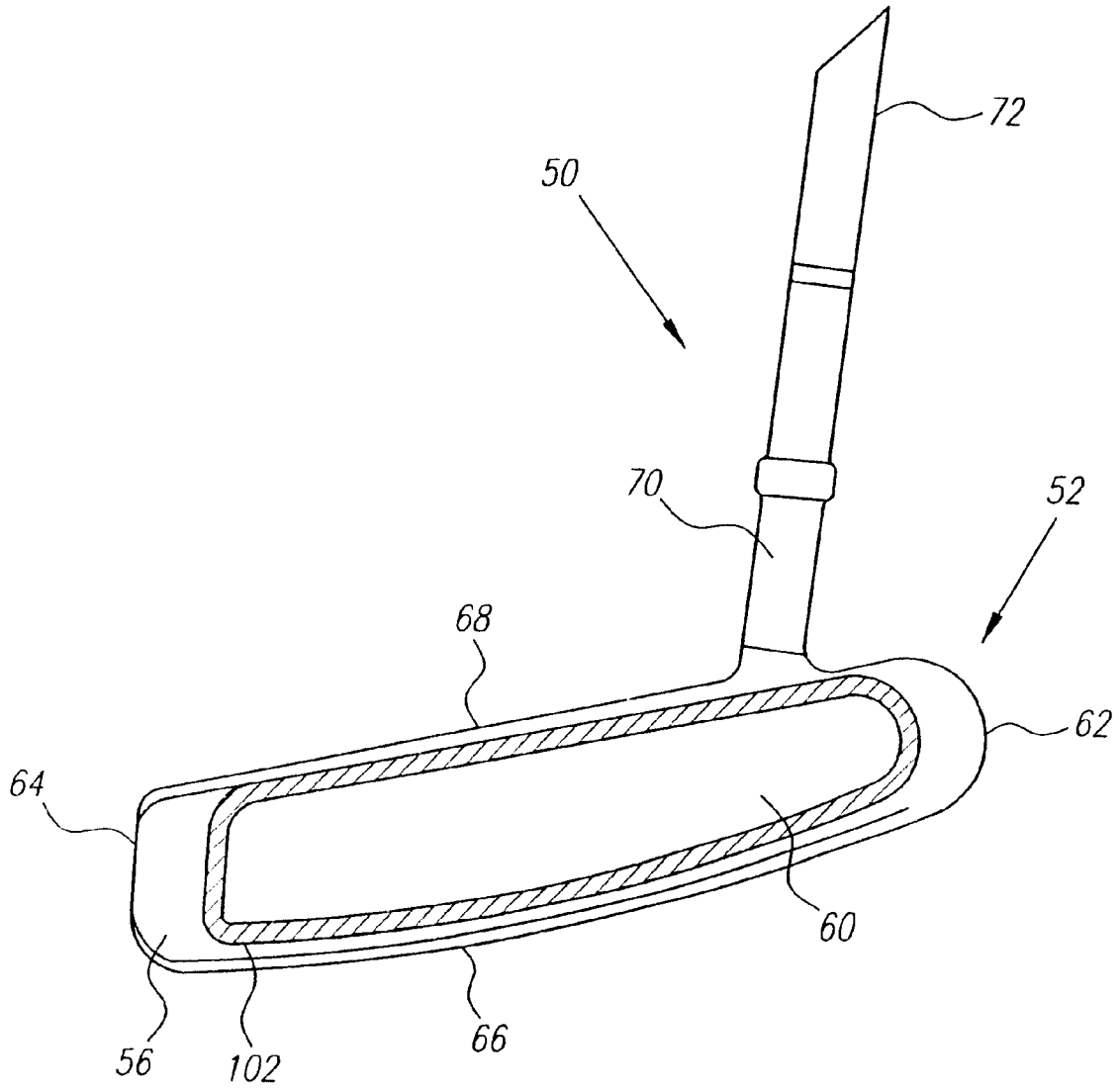
FIG. 15 is a front view of a putter of the present invention.

FIGS. 14–14B illustrate the attachment of the polymer insert 60 to the club head 54. The plurality of tabs 100 hold the insert in place, allowing it to "float" while the adhesive curves. The plurality of tabs 100 allow for precise depth placement of the insert within the recess. Such precision is not available in the prior art. Further, the ability of the insert 60 to "float" due to the plurality of tabs 100 also eliminates a tooling step in the manufacture of the club head of the present invention. As shown in FIGS. 14–14B, the polymer insert 60 is held within the recess 58 by the tabs 100 on the perimeter of the insert 100, an adhesive 102 applied into the spacings between the tabs 100, and an adhesive 104 applied to the recess frontal wall 80 and/or the interior surface 124 of the insert 60. In a preferred embodiment illustrated in FIG. 15, the adhesive 102 is applied along the entire perimeter 120, not shown, of the insert 60 thereby covering each of the plurality of tabs 100. A preferred adhesive is DP460 epoxy adhesive from 3M of Minneapolis, Minn. Other possible epoxies are JET WELD® urethane epoxy, and DP270, both available from 3M. Other adhesives may be utilized in practicing the present invention, however, the thermal coefficient of the adhesive should be applicable to manufacturing, distributing and playing temperatures of club heads.

In a preferred embodiment, the insert 60 is composed of a polyurethane material as described in co-pending U.S. patent application No. 09/389,804, entitled A Golf Club Head With A Polymer Insert, filed Sep. 3, 1999, and hereby incorporated by reference in its entirety. However, the insert 60 may be composed of other materials such as various polymers and the like.

A preferred method of manufacturing the inserts 60 composed of polyurethane is through use of a vertical mold and a laser cutter. The polyurethane prepolymer blend and curing agent are preferably stored separately. The polyurethane is formed by first heating and mixing the polyurethane prepolymer blend with the curing agent in a mold, and then curing the mixture by applying heat and pressure for a predetermined time period to form a sheet of material with a predetermined thickness. The thickness of the insert 60 may vary depending on its application. A preferred thickness for a putter 50 is in the range of 0.125 to 0.500 inches. A preferred range of thicknesses is 0.188 inches to 0.200 inches. A preferred thickness is 0.198 inches. The thickness of the insert 60 is increased or decreased to influence the feel to the golfer during impact with a golf ball. The absence of a catalyst (e.g. dibutyl tin dilaurate, a tertiary amine, etc.) allows for better control of the process in forming a sheet with a uniform thickness. Furthermore, additives such as colorants may also be added to the mixture.

The polyurethane prepolymer blend material is preferably degassed and warmed in a first holding container prior to processing of the mold sheet. The processing temperature for the polyurethane prepolymer blend is preferably in the range of about 100–220° F., and most preferably in the range of about 120–200° F. The polyurethane prepolymer blend is preferably flowable from the first holding container to a mixing chamber in a range of about 200–1100 grams of material per minute, or as needed for processing. In addition, the polyurethane prepolymer blend material may be agitated in the first holding container, in the range of 0–250 rpm, to maintain a more even distribution of material and to eliminate crystallization.

The curing agent is preferably degassed and warmed in a second holding container. The processing temperature for the curative is preferably in the range of about 50–230° F., and most preferably in the range of about 80–200° F. The curing agent is preferably flowable from the second holding container to the mixing chamber in the range of about 15–75 grams of material per minute, or as needed.

The polyurethane prepolymer blend and curative mixture are preferably added to the common mixing chamber at a temperature in the range of about 160–220° F. A colorant material, such as, for example, titanium dioxide, barium sulfate, and/or zinc oxide in a glycol or castor oil carrier, and/or other additive material(s) as are well known in the art, may be added to the common mixing chamber. The amount of colorant material added is preferably in the range of about 0–10% by weight of the combined polyurethane prepolymer blend and curative materials, and more preferably in the range of about 2–8%. Other additives, such as, for example, polymer fillers, metallic fillers, and/or organic and inorganic fillers (e.g. polymers, balata, ionomers, etc.) may be added as well to increase the specific gravity of the polyurethane cover 16 of the present invention. It was discovered that the addition of barytes (barium sulfate) or a blend of barytes and titanium dioxide (preferably added in a carrier glycol and/or castor oil) to the mixture, in the amounts of about 0.01–30%, may add sufficient weight to the insert 60. The entire mixture may be agitated in the mixing chamber in the range of about 1 to 250 rpm prior to molding.

Figure 16:
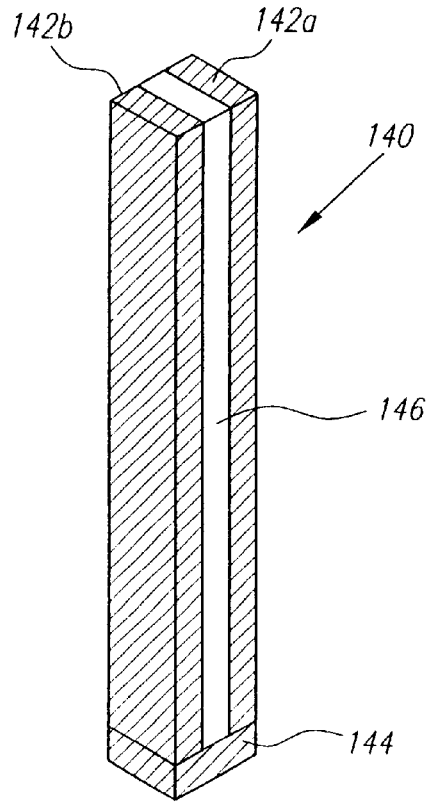
FIG. 16 is a isolated perspective view of a vertical mold utilized in the method of the present invention.
Figure 17:
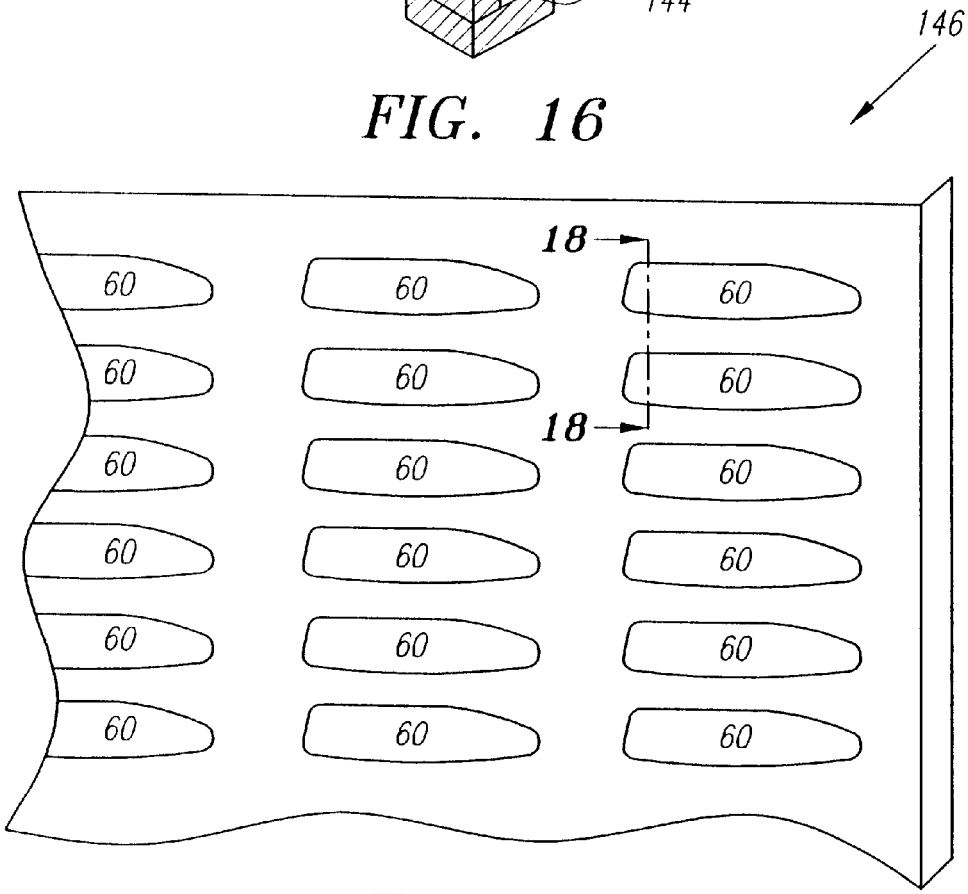
FIG. 17 is an isolated partial view of a polyurethane sheet with an initial half-cuts of the inserts.
Figure 18:
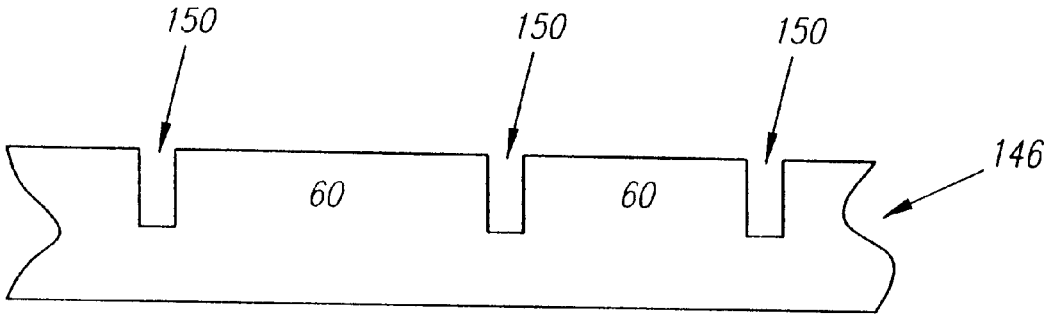
FIG. 18 is a cross-sectional view of line 18—18 of FIG. 17.
Figure 19:
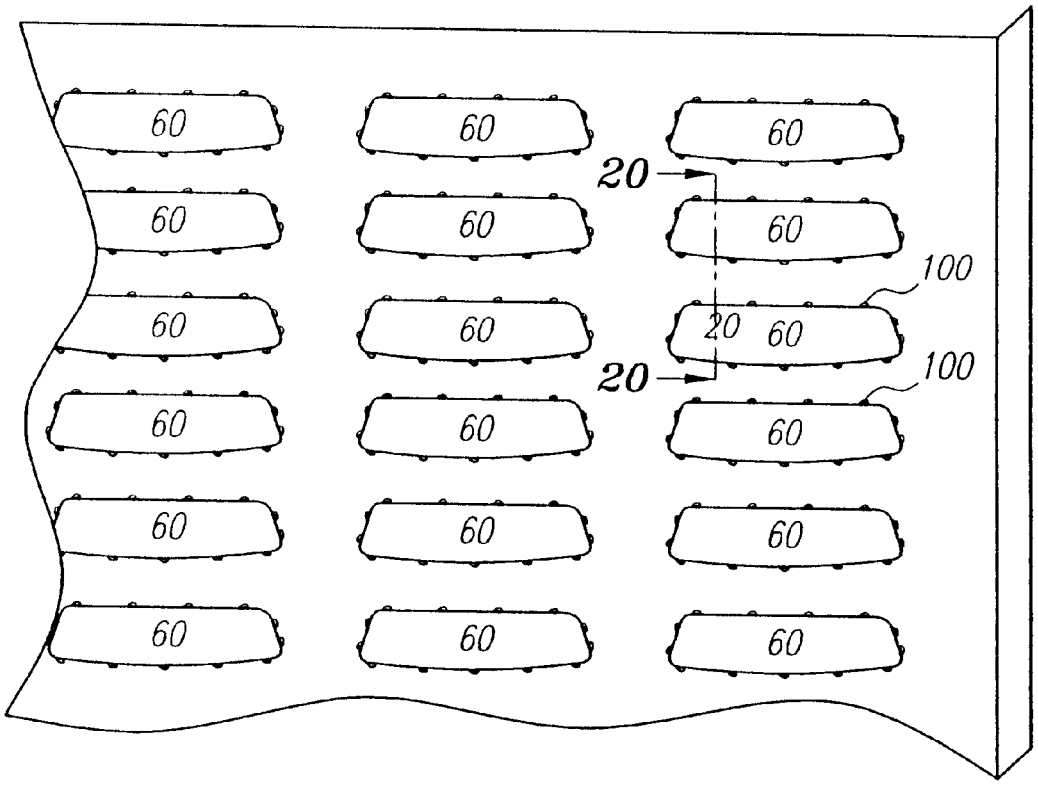
FIG. 19 is an isolated partial view of a polyurethane sheet with a full cuts of the inserts.
Figure 20:
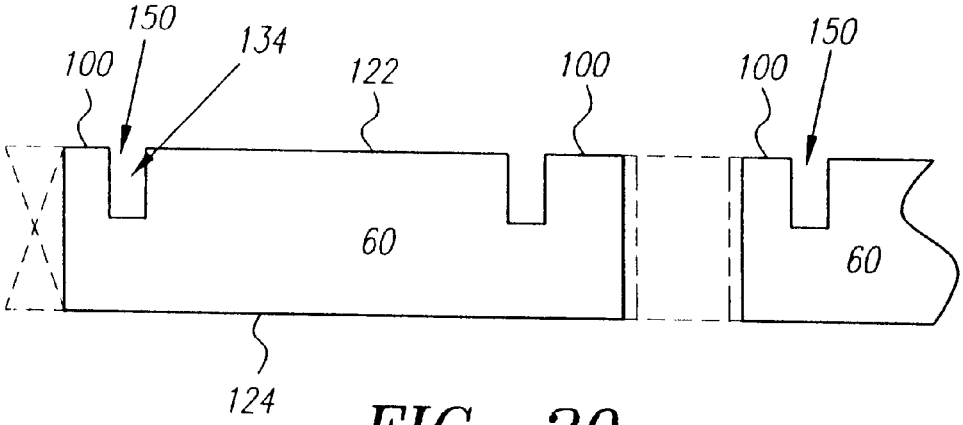
FIG. 20 is a cross-sectional view of line 20—20 of FIG. 19.

The mixture is then poured into a vertical mold and allowed to cure. As illustrated in FIG. 16, the vertical mold 140 has two side walls 142*a–b* and a base 144. The ends, not shown complete the mold 140. The two side walls 142*a–b* may have a smooth or textured surface to influence the surfaces of the insert 60. The polyurethane precursors are poured into the mold 140 and allowed to cure to form a sheet 146. Once the polyurethane has cured, the sheet 146 is removed and laser cut into the shape of inserts 60. First, as shown in FIG. 17, the body of the insert is half cut, which also forms the undercuts 134. The extent of the half-cut 150 is best shown in FIG. 18. Next, each of the plurality of tabs 100 is full cut, as is the perimeter of the body of the insert 60, with a laser to produce the completed inserts 60. FIG. 20 illustrates the full cuts to detach each individual insert 60 from the sheet 146. Also shown in FIG. 20 is a step 152 that is created during the half-cut operation. In a preferred embodiment, the laser cutting involves a laser beam that makes the half-cut 150 at a first intensity to create the undercut 134. The laser beam is then moved outward, preferably 0.0025 inches, to create the final cut. This creates the step 152 which is a minute variation in the perimeter 120. Thus, the perimeter could be viewed as having two levels, varying in height by 0.0025 inches in the preferred embodiment. The step 152 allows for a very sharp finished edge on the insert 60. The cutting operation may be performed by die-cutting instead of laser cutting.

Figure 21:
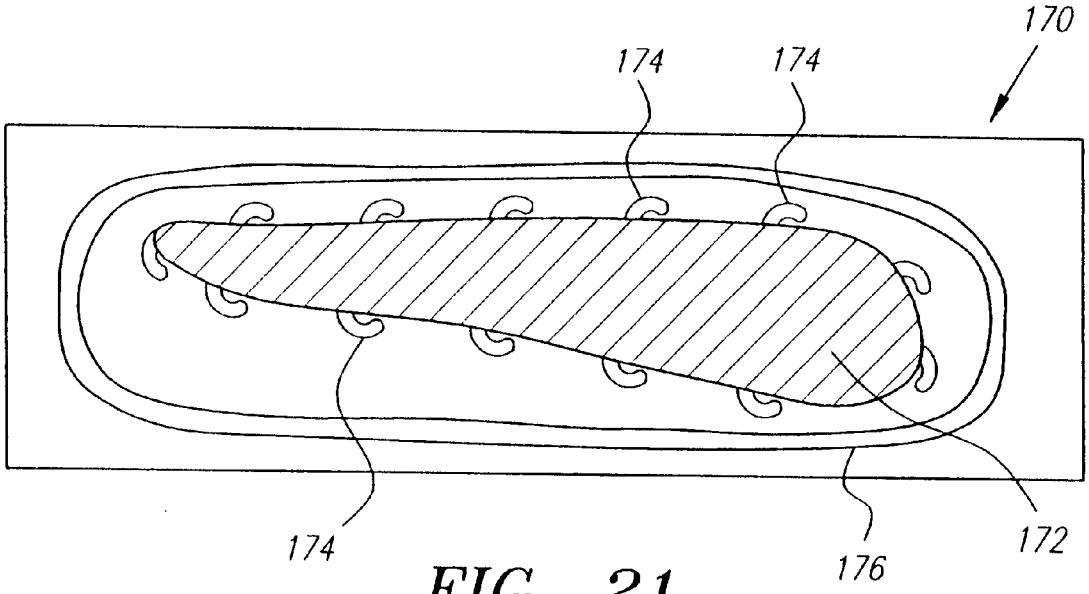
FIG. 21 is a plan view of a mold for cast molding each of the inserts in an alternative manufacturing method of the present invention.

In an alternative manufacturing operation, each individual insert 60 is molded in a cast molding operation. A cast mold half 170 is shown in FIG. 21. The cast mold half 170 has a cavity 172 of a set depth. The cavity 172 also has periphery cavities 174 for the tabs 100, which have a shallower depth than the cavity 172. An overflow channel 176 is also provided. The polyurethane precursor materials are poured into the mold half 170 and an opposing mold half 170*a*, not shown, is mated with the mold half 170. The mold, consisting of the mold halves 170 and 170*a*, is then subjected to pressure and heat for a predetermined time to cure the polyurethane material, or other material.

The inserts 60 may be coated with a protective coating such as a lacquer, a clear coat, or a paint to enhance the color of the insert. Further, an indicia may be placed on the insert using pad printing or other printing techniques.

Figure 22:
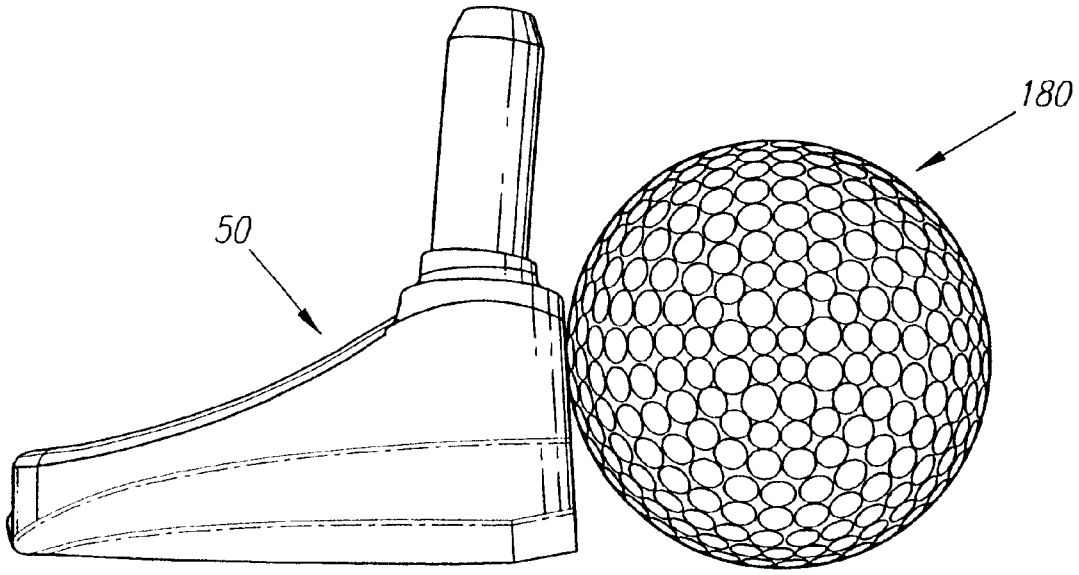
FIG. 22 is a side view of a putter with an insert of the present invention striking a golf ball with a cover that is composed of the same material as the insert.
Figure 23:
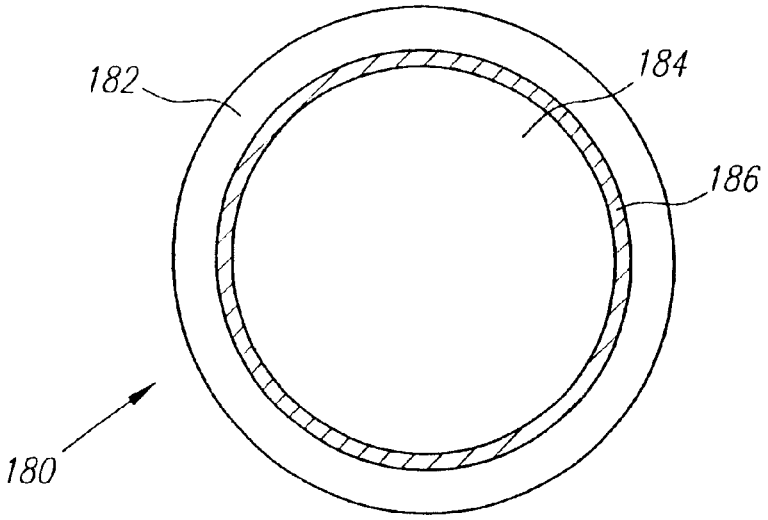
FIG. 23 is a cross-sectional view of the golf ball of FIG. 22.

As shown in FIGS. 22 and 23, another aspect of the present invention is a golf club 50 and golf ball 180 wherein a cover 182 of the golf ball 180 and an insert 60 of the golf club 50 are composed of the same material. The golf ball 180 may be a three-piece golf ball having the cover 182, a core 184 and a boundary layer 186. Alternatively, the golf ball may be a two piece golf ball with only the cover 182 and the core 184. The material of the insert 60 and the cover of the golf ball is preferably a thermoset polyurethane. Alternatively, the material is a thermoplastic polyurethane. Further, the material may be an ionomer material. Those skilled in the pertinent art will recognize that other materials may be used without departing from the scope and spirit of the present invention.

We claim as our invention:

1. A golf club and a golf ball, the combination comprising:

the golf club comprising club head body having a front face with a recess therein, and an insert disposed within the recess, wherein the insert comprises a body with an exterior surface, an interior surface and a perimeter defining the thickness of the body, the perimeter having a plurality of integral tabs extending therefrom that engage the club head body, wherein each of the plurality of tabs is compressible, and each of the plurality of tabs has a straight portion and a curved portion, the straight portion disposed between the curved portion and the perimeter, and the curved portion extending further than the straight portion to define an undercut between the curved portion and the perimeter; and the golf ball comprising a core and a cover encompassing the core;

wherein the insert of the golf club and the cover of the golf ball are composed of the same material.

2. The combination according to claim 1 wherein the material for the insert and the cover is a thermoset polyurethane.

3. The combination according to claim 1 wherein each of the plurality of tabs is disposed a predetermined distance apart from each other and the golf club head further comprises an epoxy disposed between each of the plurality of tabs.

4. The combination according to claim 1 further comprising means for attaching the insert within the recess of the body.

5. The combination according to claim 4 wherein the attachment means is an epoxy adhesive applied to the interior surface of the insert.

6. The combination according to claim 1 further comprising a protective coating on the exterior surface of the insert of the golf club head and on the exterior surface of the cover of the golf ball.

7. The combination according to claim 1 wherein the club head is selected from the group consisting of a wood club head, a putter club head and an iron club head.

8. The combination according to claim 1 wherein the golf club is a putter.

9. The combination according to claim 1 wherein the thickness of the insert is between 0.125 inch and 0.5 inch.

10. The combination according to claim 1 wherein the material for the insert and the cover is an ionomer material.

11. The combination according to claim 1 wherein the material for the insert and the cover is a polyetheramide material.

* * * * *